US005806444A

United States Patent [19]

Figueras et al.

[11] Patent Number: 5,806,444

[45] Date of Patent: Sep. 15, 1998

[54] METHOD AND AN INSTALLATION FOR TREATING WASTE BY DRYING, SUBLIMINATION, OXIDATION, AND COMBUSTION

[75] Inventors: Michel Figueras, Les Fuziers, 38540 Saint Just Chaleyssin; François Baudequin, Eaubonne, both of France

[73] Assignees: FM Industrie, Saint Chamond; Michel Figueras, Saint Just Chaleyssin; Electricite de France, Paris, all of France

[21] Appl. No.: 696,911

[22] PCT Filed: Feb. 24, 1995

[86] PCT No.: PCT/FR95/00223

§ 371 Date: Jan. 17, 1997

§ 102(e) Date: Jan. 17, 1997

[87] PCT Pub. No.: WO95/23317

PCT Pub. Date: Aug. 31, 1995

[30] Foreign Application Priority Data

Feb. 25, 1994 [FR] France ..... 94 02486

[51] Int. Cl.[6] ..... F23G 15/00

[52] U.S. Cl. ..... 110/346; 110/348; 110/245; 110/224

[58] Field of Search ..... 110/238, 245, 110/346, 348, 222, 224, 227, 228; 165/104.16

[56] References Cited

U.S. PATENT DOCUMENTS

| | | | |
|---|---|---|---|
| 3,677,404 | 7/1972 | Staffin . | |
| 3,818,846 | 6/1974 | Reese . | |
| 4,232,614 | 11/1980 | Fitch et al. | 110/238 X |
| 4,755,138 | 7/1988 | Owen . | |
| 4,777,889 | 10/1988 | Smith . | |
| 5,049,361 | 9/1991 | Harandi et al. | 110/245 X |
| 5,147,619 | 9/1992 | Cutchey et al. . | |
| 5,394,811 | 3/1995 | Weiss | 110/245 X |

FOREIGN PATENT DOCUMENTS

| | | |
|---|---|---|
| 0 224 353 | 6/1987 | European Pat. Off. . |
| 0 419 992 | 4/1991 | European Pat. Off. . |
| 0 496 250 | 7/1992 | European Pat. Off. . |
| 2 234 920 | 1/1975 | France . |

*Primary Examiner*—Henry A. Bennett
*Assistant Examiner*—Susanne C. Tinker
*Attorney, Agent, or Firm*—Bacon & Thomas

[57] ABSTRACT

Waste treatment. The installation for implementing the method comprises: a furnace (1) defining a confinement enclosure (2) for a fluidized bed (3) of particulate matter; means for recirculating the particles of the bed; means (28) for mixing, coating, and drying the recycled particles and the waste; and means for feeding the furnace from the means (28). The invention is applicable to treating moist waste.

12 Claims, 2 Drawing Sheets

METHOD AND AN INSTALLATION FOR TREATING WASTE BY DRYING, SUBLIMINATION, OXIDATION, AND COMBUSTION

TECHNICAL FIELD

The present invention relates to the technical field of treating waste, and it relates, more particularly but not exclusively, to the treatment of waste that is moist, and more specifically sludges of various origins.

By way of example, mention may be made of sludges from foodstuffs, papermaking, iron and steel making, dying, treating waste water, etc. . . .

Various difficulties need to be overcome when it is desired to treat and make inert moist waste, and in particular sludges. These difficulties include the following, without the order of enumeration being considered to be of any importance:

The first difficulty relates to the water content that must necessarily be removed so that appropriate treatment can succeed in "inerting" the residual dry matter. The neologism "inerting" should be understood as any means suitable for ensuring that, after treatment, such waste is unsuitable for giving rise to pollution of itself or by leaching. This first difficulty is associated with the need to control energy expenditure so as to ensure that the cost of treatment is acceptable.

The second difficulty is associated with the sludgy or pasty form of the waste which gives rise to a problem that is difficult to solve concerning transfer within an installation, due to the risk of clogging, setting, and bridging that can occur within transfer circuits, in particular.

The third difficulty relates to setting up, running, and monitoring a treatment method capable of reliably and completely eliminating all of the waste components capable of being destroyed by incineration. This is an objective that must necessarily be achieved in order to satisfy the requirements of regulations and legislation seeking to eliminate, in due course if not immediately, the depositing or tipping of waste in dumping grounds, whether regulated or otherwise.

PRIOR ART

Various methods have been proposed in the prior art to attempt to inert waste. Those methods can be classified into two major categories referred to as a "cold" process and as a "hot" process.

Cold processes consist in coating the waste in a matrix that may be bitumen, cement, or an appropriate plastics material. Such processes can be seen immediately to be inappropriate for moist waste, and in particular sludges.

Hot processes include the process which consists in vitrifying waste included in a mixture of silica or of alumina. Vitrification takes place at a very high temperature generated by technical means that are expensive, complex, and fragile, which cannot be envisaged for treating all waste, and above all are unsuitable for moist waste.

The prior art proposes a processing method that is more specifically intended for such waste. That method as taught by U.S. Pat. No. 3,677,404 consists in creating a fluidized bed in an incineration furnace, the fluidized bed being made up of solid inert mineral particles, e.g. constituted by grains of sand, with such a bed being heated to an appropriate temperature, e.g. close to 750° C.

The particles flow from the bottom of the bed up towards the top level from which they are recycled to be incorporated in waste. The resulting mixture is received in a filter tower for removing at least a portion of the moisture.

A bottom take-off device is provided to extract the mixture from the filter tower and direct it to the input of a feed system which delivers the mixture of hot articles to the furnace, at the base of the fluidized bed.

In this way, it is expected that the waste-and-particle mixture will possess the property of being put into circulation and, by feeding the furnace continuously, will follow an upward path in the fluidized bed with it being possible for burnable components to be incinerated therein.

That technique which was put forward in 1970 does not appear to be capable, in fact, of genuine industrial application to moist waste, and in particular to sludges, because it suffers from various drawbacks.

The first stems from the desire to pass the mixture through the filter tower. This proposition is easily understood since its purpose is to eliminate a major fraction of the included water prior to entry into the furnace by taking advantage of the heat stored in the particles. However, proceeding in that way leads to the mixture becoming packed in an enclosure in which the mixture inevitably begins to set with the consequence, at best, of lumps being formed, and at worst, of cake or layers being built up that oppose subsequent extraction.

The second drawback comes from the fact that the mixture delivered by the filter tower is non-uniform in character which is unfavorable to achieving a complete incineration process within the bed.

The third drawback comes from the fact that the bed is fluidized by the exhaust gases from a burner which serves to raise and maintain the temperature of the recyclable inert particles. When the bed is deep, as recommended, in order to obtain sufficient transit time, incineration of the "burnable" components cannot take place genuinely and effectively because of a lack of oxygen.

An object of the present invention is to overcome the above-enumerated drawbacks in order to propose a method of inerting moist waste, and more particularly sludges, which method is genuinely effective, consumes relatively little energy, and is capable of flexible operation, particularly with respect to temperature regulation of the bed adapting automatically to take account of the energy given off by the real and complete combustion of the burnable components.

SUMMARY OF THE INVENTION

To achieve this object, the method of the invention, of the type consisting in:

- creating a bed of inert particles in the confinement enclosure of a furnace, with a fluid under pressure being injected into the base of the bed to maintain a fluidized bed;
- maintaining the fluidized bed at a treatment temperature by heater means outside the enclosure;
- defining a maximum top level of the fluidized bed and extracting any surplus from said level;
- mixing the waste with a fill of mineral matter in particulate form;
- injecting said mixture into the base of the bed;
- subjecting the mixture to an upward path through the bed;
- extracting from the roof of the furnace the gases that are produced and directing them to a treatment installation; and
- extracting the surplus fluidized bed from the top level; is characterized in that it consists in:

recycling the hot inert particles extracted from the bed to a section of a mixer unit;

admitting an appropriate proportion of moist waste to be treated into said section;

performing mixing in the section;

churning and moving the mixture through a coating-and-drying section where the waste agglomerates as a layer on each particle to form a deposit that is dried, at least in part;

recycling the coated particles directly to the base of the bed; and maintaining fluidization of the bed by an oxygen-containing fluid under pressure delivered at least to the base of the bed.

Various other characteristics appear from the following description given with reference to the accompanying drawings which show embodiments of the invention as non-limiting examples.

BEST MANNER OF PERFORMING THE INVENTION

Figure 1:
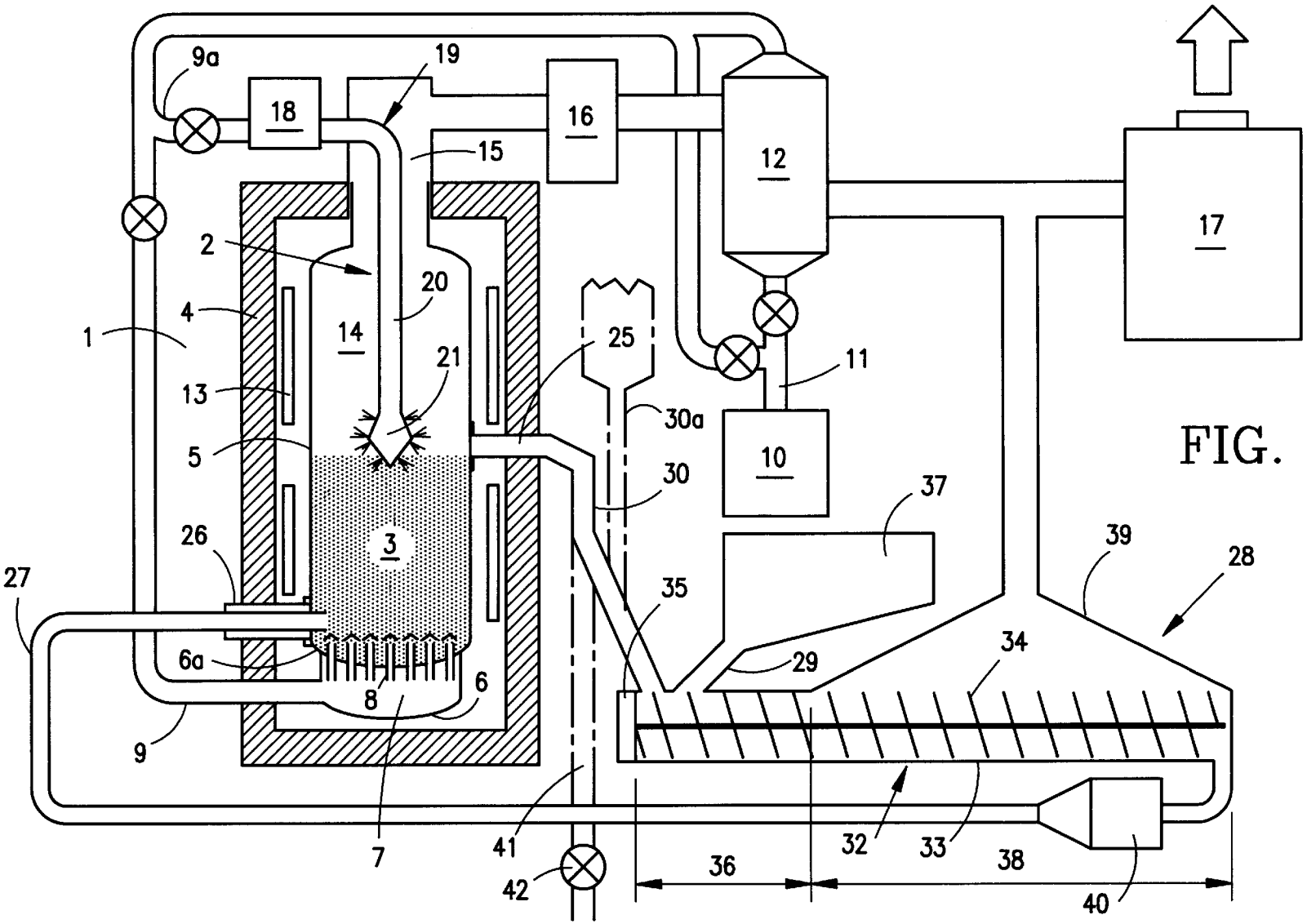
FIG. 1 is a diagrammatic view illustrating an installation for implementing the method.

FIG. 1 shows a first embodiment of an installation for implementing the treatment method. Such an installation comprises a furnace 1 defining an enclosure 1 for confining a bed 3 of inert mineral matter or material in particulate form. The enclosure 2 is preferably made in such a manner as to enable the depth of the bed 3 to be relatively large, e.g. lying in the range 1 meter (m) to 2.50 m. The inert mineral matter used is selected from silica, alumina, lime, and zircon, with a grain size suitable for being fluidized. By way of example, mean particle diameter may lie in the range 100 micrometers to 2,000 micrometers. The bed 3 may be formed out of a single mineral matter, or it may be a composition of a compatible plurality thereof.

The furnace 1 has an insulating envelope 4 constituted of material suitable for forming a barrier that limits the propagation of heat from the inside of the furnace to the surroundings. Inside the insulating envelope 4 there is a vessel 5 defining the enclosure 2. The vessel 5 has a bottom 6 and a double bottom 6*a* defining between them a manifold 7 for receiving and distributing pressure for a purpose that is described below.

The double bottom 6 is provided with fluidization nozzles 8 that open out to the inside of the manifold 7 which communicates with a circuit 9 adapted to supply an oxygen-containing gaseous fluid under pressure for the purpose of fluidizing the bed 3. The gaseous fluid for fluidizing may be provided, for example, by a blower 10 whose output 11 can be connected to the circuit 9, either directly, or else indirectly via a reheat system 12 of any appropriate type, preferably a heat exchanger whose second circuit is described below.

The furnace 1 also includes heater means 13 constituted by static means capable of heating the bed 3. Such means 13 are preferably constituted by electrical resistance elements disposed between the vessel 5 and the insulating envelope 4, being distributed at least up the full height corresponding to the depth of the bed 3, and preferably also over the height of a chamber 14 constituting the roof of the enclosure and defined therein by the level of the top of the bed 3. The top of the chamber 14 communicates with a chimney 15 passing through the insulating envelope 4 to extract flue gases and other gaseous products that develop within the enclosure 2. The chimney 15 leads to a cyclone 16 for separating out any dust, prior to being connected to the reheat system 12 to pass along the second circuit thereof, which system is implemented in the form of a dual circuit heat exchanger. The exchanger 12 is also connected to a flue gas treatment unit 17 made in any known manner for ensuring depollution.

According to another disposition of the invention, the circuit 9 includes a parallel branch 9a suitable for passing through a reheater 18 whose output is connected to means 19 for delivering oxidizer to the inside of the enclosure 2. By way of example, the means 19 may be constituted by a blowpipe 20 whose end is provided with a diffuser 21 that may be situated immediately above the top of the bed 3 or with at least a portion inside the bed.

According to another disposition of the invention, the level of the top of the bed 3 inside the enclosure 2 is determined by extractor means 25 which may make use of active means of the Archimedes' screw type driven by a motor, or of passive means such as an overflow via a spillway.

The enclosure 2 is provided with feed means 26 for feeding it with waste to be treated. Within the meaning of the invention, the term "waste" should be understood most broadly to cover any moist matter, and more generally sludges.

The feed means 26 may be constituted by a tube containing an Archimedes' screw or it may be a pneumatic transfer system. In any event, the means 26 lead to the bottom portion of the vessel 5 substantially at the level of the double bottom 6*a* and above the outlets of the nozzles 8. The feed means 26 are connected via a feed line 27 to a mixer unit 28 having a first inlet 29 for receiving waste to be treated and a second inlet 30 for receiving a fill of mineral matter in particulate form coming directly from the means 25.

The mixer unit 28 comprises a box 32 defining a trough or gutter 33 for receiving at least one Archimedes' type mixer screw 34 rotated by an actuator 35. The trough 33 defines a "mixing" section or zone 36 in which the inlets 29 and 30 terminate. The inlet 29 is connected upstream to a waste feed apparatus 37 which may be a buffer tank provided with extractor means, a grinder, a kneader, an agitator, or even a granulator, if the moist waste has previously congealed. Following the zone 36, the trough 33 defines a "coating-and-drying" zone or section 38 under a hood 39 which is connected to the flue gas treatment circuit, e.g. between the reheater system 12 and the treatment unit 17. At its end remote from the section 36, the trough 33 is connected to the line 27 via a launching apparatus 40.

The method of the invention consists in heating the enclosure 2 by the means 13 so as to keep the bed 3 at a constant temperature lying in the range 400° C. to 1000° C., and typically about 900° C.

Once the desired temperature has been reached and is being maintained by servo-control means that are not directly part of the invention, the mixer unit 28 is put into operation.

When first put into operation, inert mineral particles at an appropriate temperature are supplied, e.g. by an auxiliary circuit 30*a* for maintaining operation in closed circuit mode. Once this operating mode has been achieved, the inert particles come directly from the furnace 2 by being extracted from the top level of the bed 3.

The hot mineral particles are poured into the zone 36 where they are churned up by rotation of the screw(s) 34. The zone 36 also receives a corresponding quantity of waste via the inlet 29, which waste is thus mixed with the particles in the zone 36.

The screw(s) 34 then maintain effective churning of the mixture in the zone 38 where the hot inert mineral particles are progressively coated while delivering their heat to the layer of waste that forms progressively a relatively thin dry deposit. Given the large specific area represented by the particles, high drying power is applied to the waste and the vapor given off is collected by the hood and is evacuated.

After passing through the box 28, the waste is fully incorporated as a coating on the particles, and the mixture obtained in this way can be considered as being uniform.

The coated particles are then extracted from the box 28 and taken by the launcher 40 so as to be conveyed by the line 27 to the means 26 that inject them into the bed 3 whose fluidized state is maintained by feeding in an oxygen-containing flow of gas (optionally heated) as delivered by the blower 10 to the bottom manifold of the vessel 5.

On being injected into the fluidized bed, the coated particles are subjected to thermal shock that raises the deposit of waste to the ambient temperature of the fluidized bed.

This temperature rise takes place quickly given the relatively small thickness of the deposit of dried waste on each particle. The thermal shock makes the deposit sufficiently brittle to break up and the temperature of the bed maintains combustion of the burnable compounds as the particles then rise together with the waste inside the fluidized bed 3.

The upward travel is positively controlled while the particles are in the bed, given that the particles and the waste are trapped in a kind of fluid matrix whose uniformity is ensured by the fact that the coated mineral particles are of the same kind and the same grain size as the particles constituting the fluidized bed.

The transit time is consequently relatively long because of the depth of the fluidized bed 3, and as a function of the operating parameters of the furnace it may be as long as several tens of minutes or even several hours, during which the waste continues to be subjected to the treatment temperature.

This temperature therefore contributes to combustion of the combustible portions of the waste, oxidizing of the oxidizable portions, and indeed sublimation of the sublimable portions. Thus, the leachable substances decompose partially in the gaseous phase, e.g. salts in the form of chloride, with the gaseous phase being removed from the treatment and reaction enclosure 2 via the chimney 15 where it is optionally subjected to separation of the included fine particles within the cyclone 16 prior to passing through the heat exchanger 12 that enables the energy budget of the installation to be improved in operation. Beyond the heat exchanger 12, the flue gases are washed and depolluted by the unit 17 acting in conventional manner.

The residual portion of the waste in solid form can be burned in part and oxidized in part by the effect of the oxygen surrounding each of the particles, which oxygen comes from the gaseous fluid used for fluidizing the bed 3. The presence of oxygen inside the enclosure 2 can be improved by providing for delivery via the blowpipe 20, e.g. for the purpose of maintaining an oxygen partial pressure in the chamber or roof 14 above the bed at above 2000 Pascals, thereby maintaining an oxidizing atmosphere.

Oxidizing of the residual portion in solid form also occurs because of the temperature that is maintained inside the enclosure 2 and because of the long transit time imposed on the particles travelling along an upwards path within the fluidized bed 3.

The consequence of supplying mixture for treatment either continuously or discontinuously is to increase the mass of the fluidized bed 3 and as a result surplus bed is taken off from the top by the extraction means 25. This surplus is constituted by the mineral matter in inert particulate form, possibly together with an inert solid fraction of the waste.

Depending on the nature of the waste, delivery to the zone 36 can include particulate matter in a concentration that lies in the range 15% to 80% relative to the waste.

Thus, in the sense of the invention, the recommended method makes use of inert particles that can be considered as being carriers which, in the above case, travel round a closed circuit to facilitate the hydrodynamics, the handling, and the circulation of waste through the installation.

The included particles also act as a vector of heat energy that enhances drying of the moist waste while mixing is taking place in the unit 28.

This disposition makes it possible to treat a broad spectrum of moist waste including direct treatment of organic and hospital waste, e.g. with provision to congeal it initially so as to enable it to be ground up and/or granulated to enhance incorporation of the recycled inert matter whose temperature on leaving the furnace ensures rapid drying during the mixing stage in the unit 28.

In an installation of the invention, it is possible to extend the inlet 30 by means of a drawing-off tube 41 provided with a valve 42 so as to remove from the recirculating mass a portion that corresponds to the progressively increasing residual presence of solid fraction from the treated waste.

Figure 2:
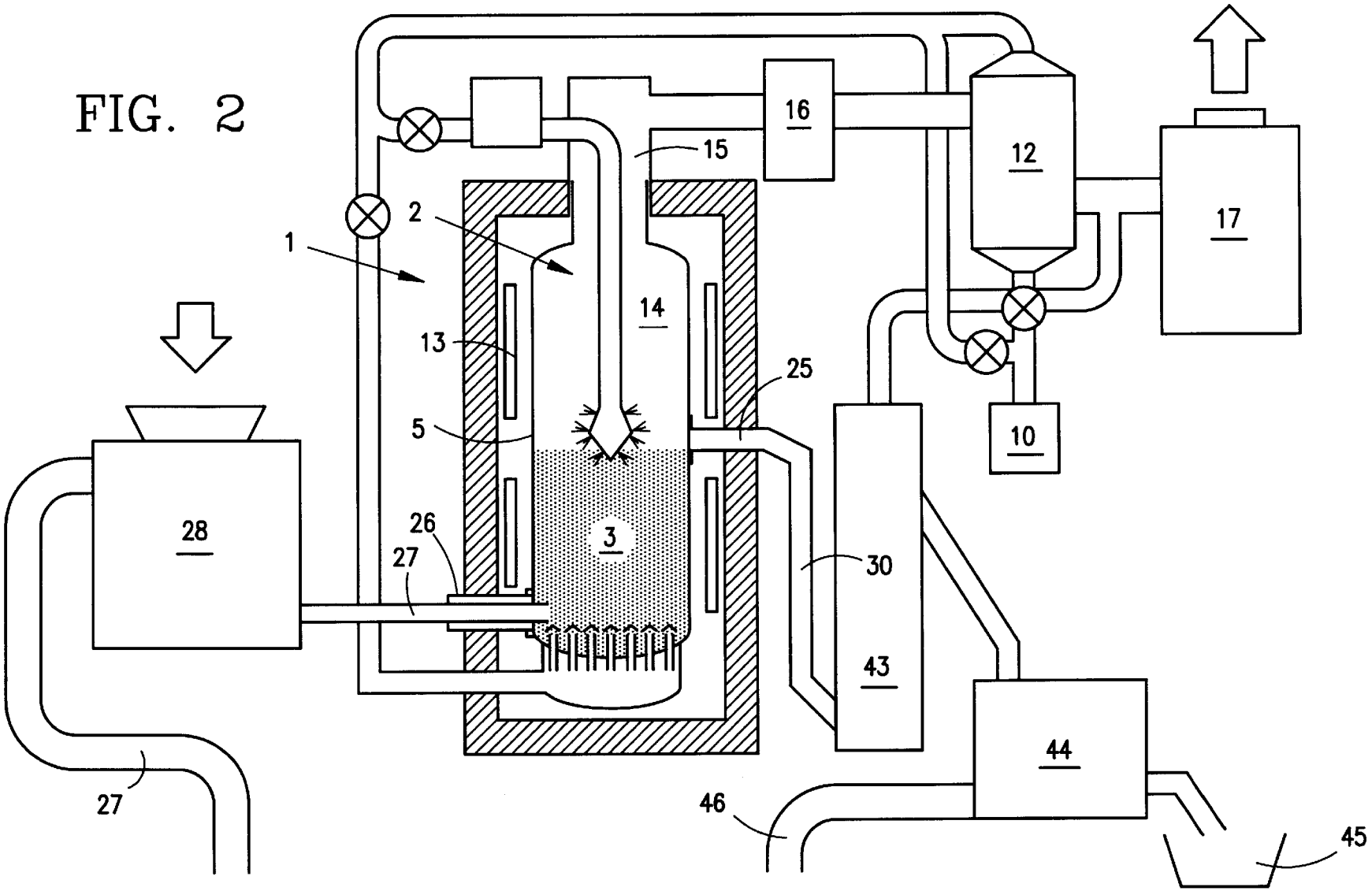
FIG. 2 is a diagrammatic view showing a variant embodiment of the installation.

FIG. 2 shows a variant embodiment in which the recirculation means 30 are directed, optionally after passing through a cooler 43, to a separator 44 that is capable by any appropriate means such as centrifuging or mechanical cleaning, of separating the particulate inert matter and the solid fraction of waste that together constitute the surplus extracted from the bed 3 by the means 25. Under such circumstances, the separated solid fraction is removed to a unit such as 45 for conditioning or compacting ultimate waste, while the fraction comprising inert particulate matter is recycled via a line 46 to reach the inlet 29.

INDUSTRIAL APPLICATION

A preferred application of the invention lies in treating waste water sludge.

The invention is not limited to the examples described and shown since various modifications can be made thereto without going beyond the ambit of the invention.

We claim:

1. In a method of treating waste by drying, subliming, oxidizing, and combustion, the method being of the type which comprises:

creating a bed of inert mineral particles in a confinement enclosure of a furnace, with a fluid under pressure being injected into the base of the bed to maintain a fluidized bed;

maintaining the fluidized bed at a treatment temperature by heater means outside the enclosure;

defining a maximum top level of the fluidized bed and extracting any surplus from said level;

mixing the waste with a fill of inert mineral particles;

injecting said mixture into the base of the bed;

subjecting the mixture to an upward path through the bed whereby said waste is combusted in said fluidized bed resulting in the production of gas;

removing from the furnace the gases that are produced and directing said gases to a treatment installation; and extracting the surplus fluidized bed from the top level;

wherein the improvement comprises:

recycling the hot inert particles extracted from the bed to a section of a mixer unit (28);

admitting an appropriate proportion of moist waste to be treated into said section;

performing mixing in the section;

churning and moving the mixture through a coating-and-drying section where the waste agglomerates as a layer on each particle to form a deposit that is dried, at least in part;

recycling the coated particles directly to the base of the bed; and maintaining fluidization of the bed by an oxygen-containing fluid under pressure delivered at least to the base of the bed.

2. A method according to claim 1, characterized in that the inert mineral particles are selected from the group consisting of silica, alumina, zircon, and lime, with a grain size of mean diameter lying in the range 100 micrometers to 2,000 micrometers.

3. A method according to claim 1, characterized in that the inert mineral particles are mixed with the waste at a concentration lying in the range 15% to 80%.

4. A method according to claim 1, characterized in that the inert mineral particles and the waste are subjected to a treatment temperature lying in the range 400° C. to 1000° C.

5. A method according to claim 1, characterized in that the inert mineral particles and the waste are subjected to a transit time in the fluidized bed lying in the range a few tens of minutes to several hours.

6. A method according to claim 1, characterized in that an oxygen partial pressure is maintained in the furnace.

7. A method according to claim 6, characterized in that the oxygen partial pressure is greater than 2000 Pascals.

8. A method according to claim 1, characterized in that the surplus is recycled to an installation for separating the fill of inert mineral particles from the residual inert dry fraction of the waste.

9. In an installation for implementing the method according to claim 1, the installation being of the type comprising:

a furnace (1) defining a confinement enclosure (2) for a fluidized bed (3) of matter;

a circuit (9) for feeding a fluid under pressure, said circuit opening out into the bottom of the enclosure to fluidize the bed;

feed means (26) for feeding substances to be treated to the base of the bed;

means (25) for extracting surplus bed from the top level thereof; and a mixer unit for mixing the waste to be treated and the surplus matter extracted from the bed; wherein the improvement comprises:

a fill of inert mineral particles occupying the confinement enclosure of the furnace to constitute the fluidized bed;

a mixer unit (28) comprising firstly a mixer section in which there terminate a hot inert particle inlet and a waste inlet, and secondly a coating-and drying section, and thirdly an outlet;

upstream from the feed means and connected thereto a prior mixing unit (28) for mixing a given fraction of waste to be treated and of hot inert matter fill of the same kind as the matter of the bed; and recycling means (27) connecting the outlet of the unit (28) to the base of the furnace.

10. An installation according to claim 9, characterized in that the mixer unit is implemented in the form of a box defining a trough containing at least one mixer apparatus and defining the mixing section and the coating-and-drying section.

11. An installation according to claim 9 characterized in that the coating-and-drying section is under a hood for collecting and removing vapor.

12. An installation according to claim 9, characterized in that the recycling means include a separator (44) for separating the inert mineral particles from the inert residual dry fraction of the treated waste.

* * * * *